US005526594A

United States Patent [19]

Fourny et al.

[11] Patent Number: 5,526,594

[45] Date of Patent: Jun. 18, 1996

[54] STEAM IRON WITH STEAM AND SPRAY PUMP

[75] Inventors: Jacky R. P. Fourny, Berus; Gérard L. H. Guillot, Radon, both of France

[73] Assignee: Moulinex S.A., Bagnolet, France

[21] Appl. No.: 503,802

[22] Filed: Jul. 18, 1995

[30] Foreign Application Priority Data

Jul. 18, 1994 [FR] France ..... 94 08865

[51] Int. Cl.[6] ..... D06F 75/10; D06F 75/22; F04B 7/02

[52] U.S. Cl. ..... 38/77.5; 38/77.83; 222/330; 417/442

[58] Field of Search ..... 38/77.1, 77.5, 38/77.8, 77.81, 77.83; 417/442, 478, 330, 331

[56] References Cited

U.S. PATENT DOCUMENTS

| | | | |
|---|---|---|---|
| 3,881,265 | 5/1975 | Eaton et al. | 38/77.5 |
| 4,170,835 | 10/1979 | Bain, Jr. | 38/77.5 |
| 5,035,501 | 8/1991 | Hipp et al. | 38/77.5 |
| 5,136,796 | 8/1992 | Farrington | 38/77.5 |

*Primary Examiner*—Ismael Izaguirre
*Attorney, Agent, or Firm*—Young & Thompson

[57] ABSTRACT

An electric steam iron comprises a pump (20) adapted to remove a quantity of water from a reservoir (17) and to send this quantity, via a selection device (24), either into a steam chamber (14) so as to obtain abruptly an abundant emission of steam through holes in the sole, or to a cold water spray (25), this pump being of the type having a piston (27) movable in an intake chamber (31). The selection device comprises a deformable membrane (56) with two valves (58, 59) associated respectively with two openings, namely an injection opening (44) connected to the steam chamber (14) and a spray opening (45) connected to the spray chamber (25) and subjected respectively to two manual control buttons, namely, a steam button (62) and a spray button (63). The membrane (56) occupies a working position, defined when one or the other of the two buttons (62, 63) is actuated, in which the valve associated with the actuated button is maintained closed and obstructs the corresponding opening, while the valve associated with the other button opens by deformation of the membrane (56) effected by pressure of the pressurized water and clears the corresponding opening through which passes the pressurized water.

8 Claims, 4 Drawing Sheets

STEAM IRON WITH STEAM AND SPRAY PUMP

The present invention relates to steam irons which comprise a heating sole having in its lower surface a series of steam outlet openings and in its upper surface a vaporization chamber connected to said holes and communicating with a water reservoir.

It relates more particularly to steam irons which moreover comprise a pump adapted to take from a reservoir a quantity of water and to transmit this quantity by means of a selection device, either into the vaporization chamber so as to obtain immediately an abundant emission of steam through the holes of the sole, or into a cold water spray situated in the forward portion of the iron, this pump being of the piston type moving in an intake chamber which is provided in the body of the pump and which opens into the reservoir via an anti-return valve.

It is known that with such irons, the abrupt emission of steam or "supersteam" is useful to effect the setting of the pleats in thin cloth, for example the pleats of trousers, while the cold water spray serves for example to eliminate false pleats, particularly in cloth that is too dry.

In known steam irons of this type, the selection device ensuring the choice between supersteam and spray comprises a selecting member which is mounted rotatably in an annular fixed base and provided in its bottom with two angularly spaced openings, namely an injection opening connected to the steam chamber and a spray opening connected to the spray, and which has a flexible closure forming a turning joint adapted to close one or the other of the two openings according to the angular position of this selector member. However, such a turning joint is ultimately subject to wear by friction on the bottom of the basin which leads inevitably to the loss of water, impairing the good operation of the steam iron. Moreover, the provision and mounting of this selector member of the rotating type are relatively complicated and hence particularly costly for the mass production of steam irons.

The invention has for its object to overcome these drawbacks and to provide a steam iron provided with a selection device—supersteam or spray—which will be simple, economical and of high reliability.

In an iron according to the invention, the selection device comprises a deformable membrane having a substantially flat lower portion provided with two protuberances each serving as a valve and being maintained in place in a sealed manner in a cap which is formed in the upper portion of the piston of the pump and whose bottom, on the one hand, communicates with the intake chamber through a pressurized bore provided in said piston, and on the other hand, has two openings, namely an injection opening connected to the steam chamber and a spray opening connected to the spray, the two valves of the membrane being located respectively at the level of the two openings and their operation being subject respectively to two manual control buttons, respectively for steaming and spray, which project from the upper portion of the iron and of which the steam button is connected with the valve associated with the spray opening, while the spray button is associated with the valve associated with the injection opening, the membrane passing from a rest position, defined when the pump is started, in which the two valves are closed and obstruct respectively the two openings, to a working position, defined when one or the other of the two buttons is actuated, in which the valve associated with the actuated button is maintained closed by said button and obstructs the corresponding opening, whilst the valve associated with the other button opens by deformation of the membrane brought about by water pressure pressurized through the bore of the piston and opens the corresponding opening through which the pressurized water passes.

Thus, this deformable membrane with two valves whose opening is selectively subjected to the pressure of the pressurized water, constitutes a simple and foolproof member assuring, according to the choice of the user, a selection between the supersteam and spray functions, and this more particularly because the double valve membrane is integrated into the pump.

The characteristics and advantages of the invention will become further apparent from the description which follows of a particular embodiment given by way of nonlimiting example, illustrated in the accompanying drawings, in which.

Figure 1:
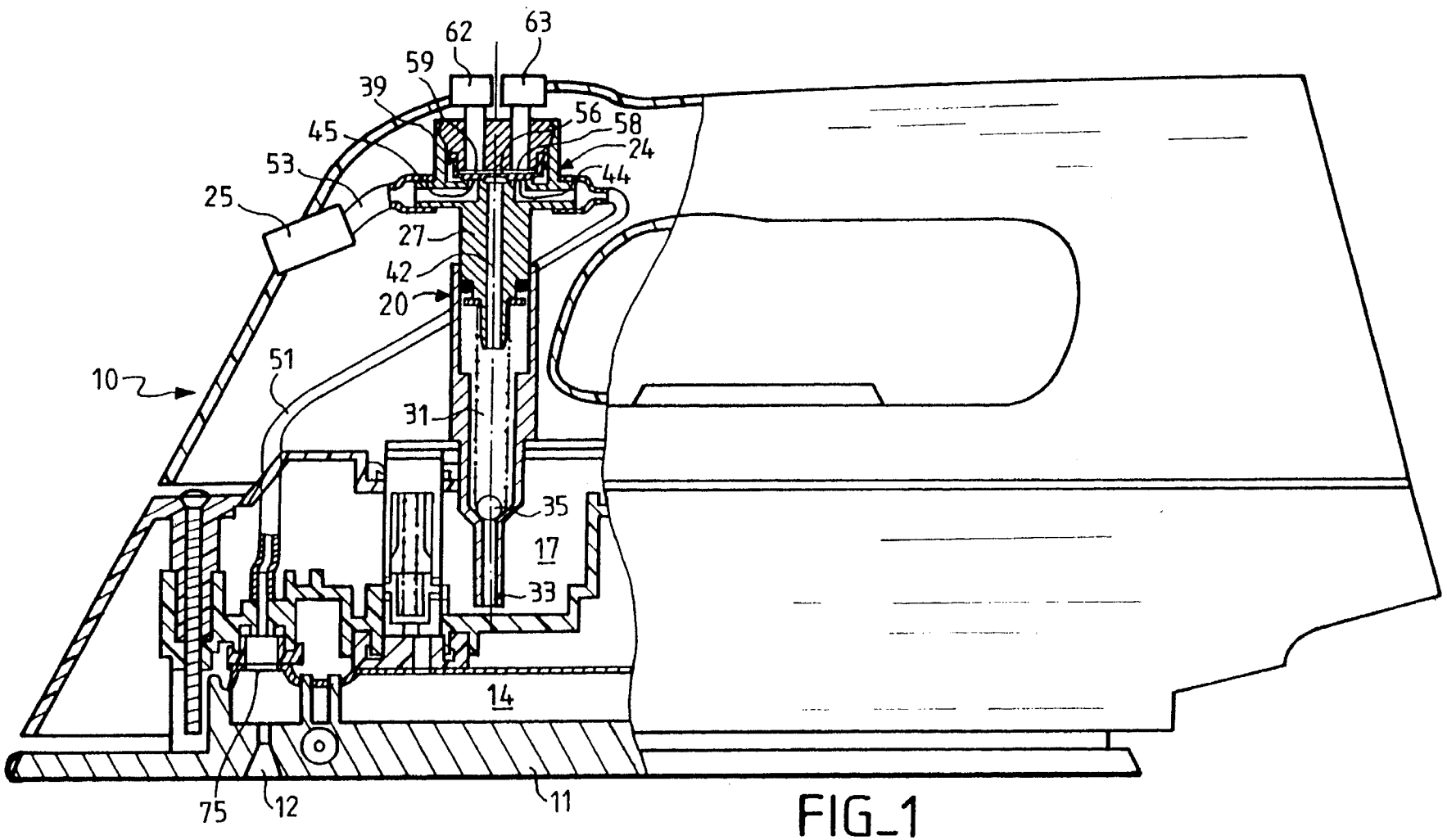
FIG. 1 is a schematic view in partial cross section of a steam iron according to the invention.

The steam iron 10 shown schematically in FIG. 1 comprises a heating sole 11 having, in its lower surface, a series of steam outlet openings 12 and, in its upper surface, a steam chamber 14 connected to the holes 12 and communicating with a water reservoir 17.

This iron moreover comprises a pump, generally shown at 20, whose body 21 has a vertical axis of symmetry XX' (FIGS. 2, 3 and 4) and which is adapted to take from reservoir 17 a quantity of water and to send this quantity, via a selection device 24 which will be described hereinafter, either into the steam chamber 14 so as to obtain abruptly an abundant emission of steam through the holes 12 of the sole 11, or to a cold water spray 25, of structure known per se, located in the forward region of the iron.

Figure 2:
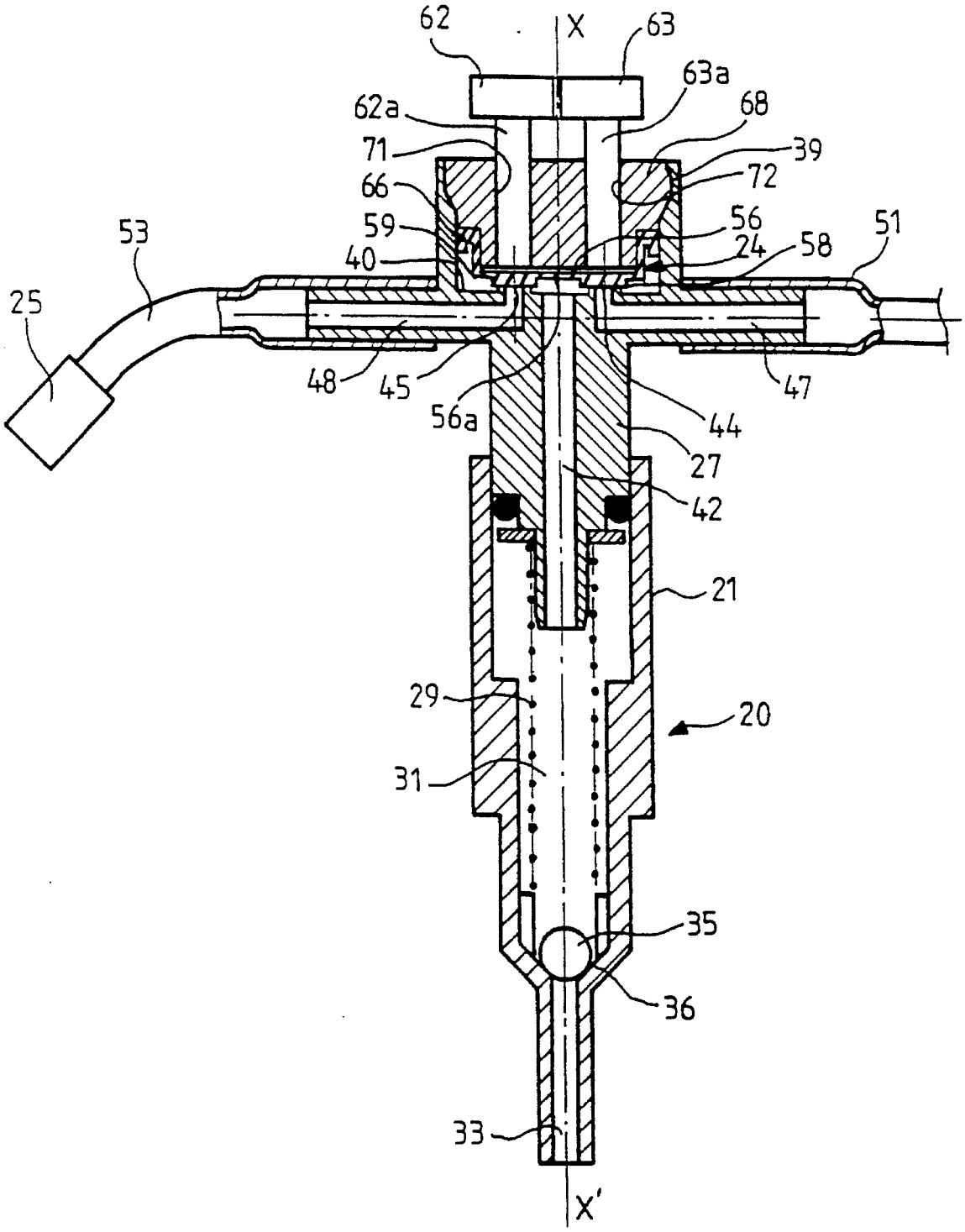
FIG. 2 is a fragmentary view on a larger scale and in cross section, of a pump mounted in the iron of FIG. 1, the pump being shown in its primed position.
Figure 3:
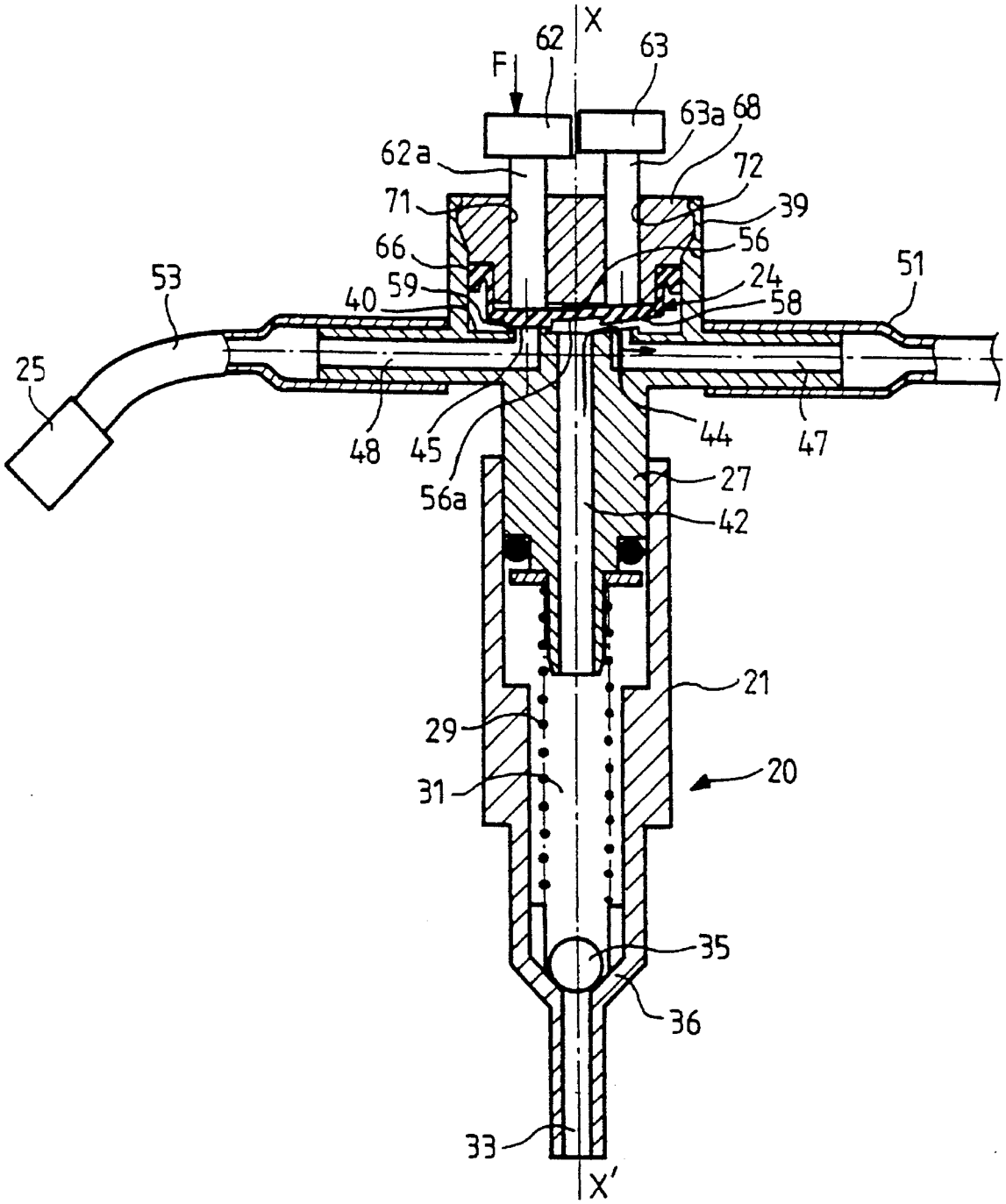
FIGS. 3 and 4 are views similar to FIG. 2, showing the pump during use of the iron for its supersteam function (FIG. 3) and spray function (FIG. 4).
Figure 4:
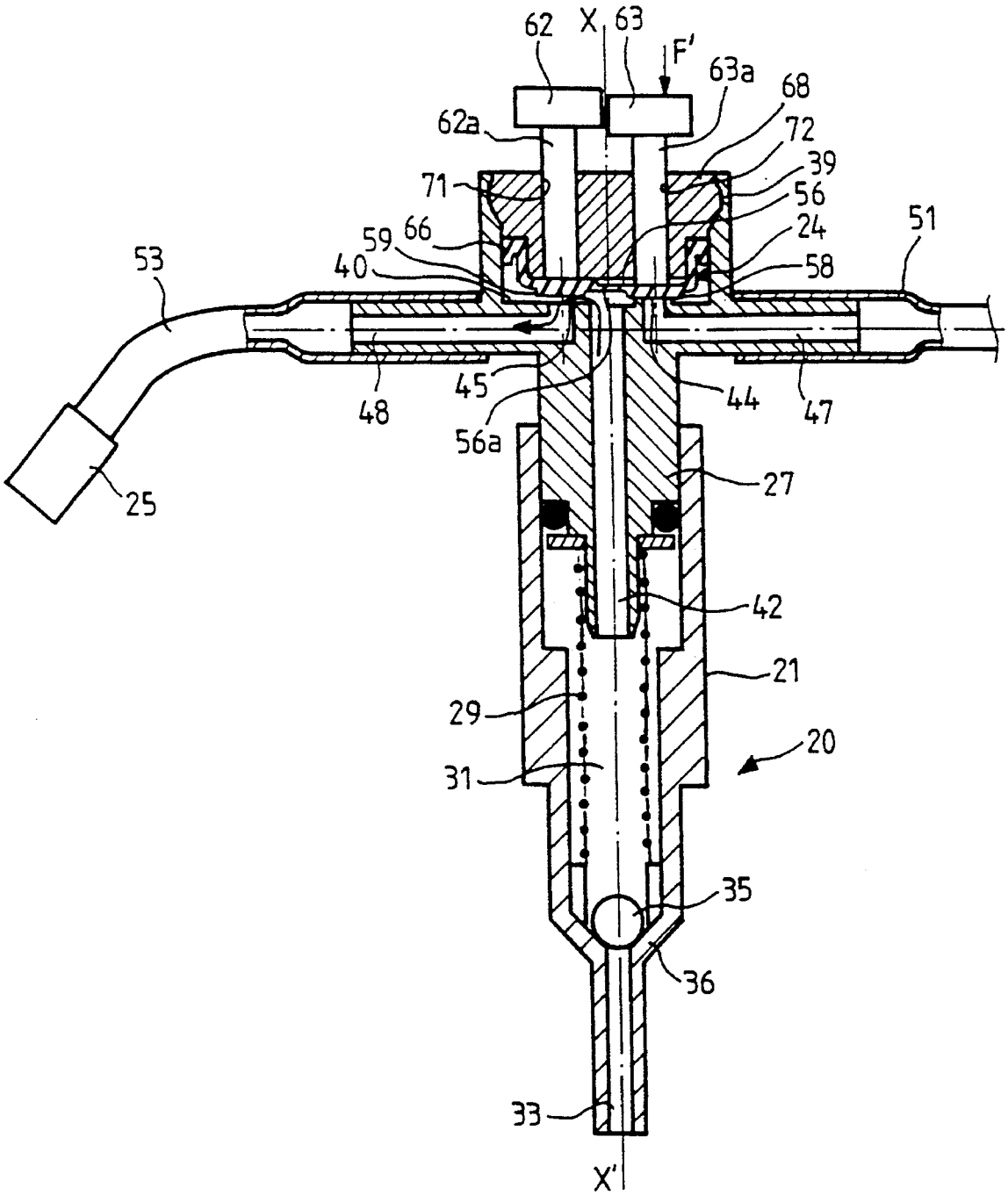

As better shown in FIGS. 2, 3 and 4, the pump 20 is of the type having a piston 27 moving in a sealed manner under the influence of an axially-disposed spring 29, within a cylindrical intake chamber 31 provided axially in the body 21 of the pump and opening at 33 into the reservoir 17 (FIG. 1) via a non-return valve constituted in this case by a ball 35 coacting with a conical seat 36.

The piston 27 of the pump 20 is prolonged in its upper portion by a cylindrical cap 39 whose bottom 40 communicates with the intake chamber 31 through a cylindrical pressure bore 42 provided axially in the piston 27, and has two openings arranged symmetrically relative to the axis XX' of the body 21 of the pump, namely an injection opening 44 connected to the steam chamber 14 of the iron (FIG. 1) and a spray opening 45 connected to the spray 25.

In the embodiment shown in FIGS. 1–4, the two openings 44 and 45 open respectively into two opposed conduits 47 and 48 orthogonal to the axis XX' of the body 21 of the pump and form an integral part of the piston 27 of the pump; the conduit 47, into which opens the injection opening 44, is connected to the steam chamber 14 by a flexible injection tube 51, whilst the conduit 48, into which opens the spray opening 45, is connected to the spray 25 by another flexible injection tube 53.

According to the invention, the selection device 24 shown in FIGS. 2–4 and adapted to permit the choice between abrupt emission of steam or "supersteam" and the spray, comprises a deformable flexible membrane 56, maintained in place in the cap 39 of the piston 27 of the pump and having a substantially flat lower portion **56*a* provided with two protuberances 58 and 59 each serving as a valve by being located respectively at the level of the two openings 44 and 45; these two valves 58 and 59 of the membrane 56 are respectively subject to actuation by two manual control buttons, respectively a steaming button 62 and a spray button 63, which project one behind the other from the upper portion of the iron (FIG. 1) and are disposed symmetrically relative to the axis XX' of the body 21 of the pump, and of which the steam button 62 is connected to the valve 59 associated with the spray opening 45, whilst the spray button 63 is connected with the valve 58 associated with the injection opening 44, the membrane 56 passing from a rest position, defined when the pump 20 is primed, in which the two valves 58, 59 are closed and obstruct respectively the two openings 44, 45, to a working position, defined when one or the other of the two buttons 62, 63 is actuated, in which the valve associated with the actuated button is maintained closed by said button and obstructs the corresponding opening, whilst the valve associated with the other button opens by deformation of the membrane 56 effected by the pressure of the pressurized water through the bore 42** of the piston and opens the corresponding opening through which passes the pressurized water.

In this embodiment, the membrane 56 has a straight section shaped substantially as a U whose bottom 56*a* carries the two valves 58 and 59, and of which the end peripheral border 66 is maintained bearing against the internal surface of the cap 39 by means of a member 68 forming a closure plug of the cap. In this example, the two buttons, respectively the steaming button 62 and the spray button 63, are push-buttons, if desired each provided with a return spring, and provided with actuating rods 62*a*, 63*a* which are engaged respectively in two bores 71 and 72 provided vertically in the closure plug 68, in line with the two valves 59, 58 of the membrane 56. Of course, these two push-buttons 62, 63 could be replaced by any other equivalent means, such as for example two swinging buttons and could also be disposed laterally one beside the other relative to the upper portion of the iron, without thereby departing from the spirit of the invention.

Preferably, the assembly formed by the membrane 56 and the two valves 58, 59 is of an elastomeric material, such as for example a silicone, and constitutes itself a sealing joint between the piston 27 and the pump and the closure plug 68.

It must be emphasized that in a preferred embodiment, the piston 27, the membrane 56 with two valves, the closure plug 68 and the two control buttons 62, 63 constitute a unitary assembly, thereby greatly facilitating the mounting of the pump within the iron.

To utilize the steam iron, after filling the water reservoir 17, the user pushed on one or the other of the steam button 62 and the spray button 63 so as to cause the piston 27 to descend into the chamber 31, then releases this button, the piston 27 rising again under the effect of the spring 29. In the course of this rising, a vacuum is created in the pump, which has the effect of applying the two valves 58, 59 against the bottom of the cap 39, thus opening the two openings 44 and 45, and the valve 35 opens and water is drawn into the chamber 31 through the inlet 33. The pump 20 is thus primed, as shown in FIG. 2.

When the user desires to make use of the supersteam function, he pushes on the steam button 62 (arrow F in FIG. 3), which maintains closed the valve 59 associated with this button 62, the corresponding steam opening 45 thus remaining completely closed. The water present in the chamber 31 is then forced, under the effect of the descent of the piston 27, through the bore 42 and the pressure of this driven water gives rise to a deformation of the membrane 56 resulting in opening of the valve 58, and hence in the clearing of the corresponding injection opening 44, see FIG. 3. There is thus obtained an abrupt injection of water into the steam chamber 14 from the pump 20 and through the injection opening 44, the conduit 47 and the tubing 51. This injection gives rise to the desired abundant emission of steam, through the holes 12 of the sole.

The pump 20, under the influence of spring 29, re-primes itself then as soon as the steam button 62 is released.

When the user now wishes to use the spray function, he presses on the spray button 63 (arrow F' in FIG. 4), which maintains closed the valve 58 associated with this button, the corresponding injection opening 44 thus remaining completely obstructed. As before, the water present in the chamber 31 is driven through the bore 42 and the pressure of the driven water gives rise to a deformation of the membrane 56 leading, in this case, to the opening of the valve 59 and hence the clearing of the corresponding spray opening 45, as is seen in FIG. 4. There is then obtained an ejection of cold water by the spray 25, from the pump 20 through the spray opening 45, the conduit 48 and the tubing 53.

It will be noted that the section of the bore 42 is larger than the section of the two openings, respectively the injection opening 44 and the spray opening 45, and of the outlet 33, so as to prevent with certainty any pressurizing of the water by the spray opening due to the pressure engendered by abrupt evaporation of the water in the steam chamber when the iron is used in its supersteam function.

Moreover, in the case of substantial overpressure in the steam chamber 14, it is preferable to interpose a non-return valve, shown at 75 in FIG. 1, between the outlet of the pump 20, on the side of the injection opening 44, and the inlet of the steam chamber 14. This non-return valve 75 is constituted for example by a perforated membrane displaceable under the action of the pressure prevailing in the steam chamber 14 and adapted to close the outlet of the injection tubing 51. Of course, this non-return valve 75 could be constituted by any other equivalent means, such for example as a simple ball or again a small collar formed in the closure plug 68, in line with the valve 58 associated with the injection opening 44, without thereby departing from the scope of the invention.

We claim:

1. In a steam iron comprising a heating sole (11) having in its lower surface a series of steam outlet openings (12) and in its upper surface a vaporization chamber (14) connected with said holes (12) and communicating with a water reservoir (17), and a pump (20) adapted to remove from said reservoir (17) a quantity of water and to send this quantity via a selection device (24) either into said steam chamber (14) so as to obtain an abrupt abundant emission of steam through the holes (12) of the sole, or to a cold water spray (25) located in the forward portion of the iron, the pump (20) having a piston (27) moving in an intake chamber (31) which is provided in a body (21) of the pump and which opens into the reservoir (17) via a non-return valve (35); the improvement wherein the selection device (24) comprises a deformable membrane (56) having a substantially flat lower portion (56*a*) provided with two protuberances (58, 59) each serving as a valve and being maintained in place in a sealed manner in a cap (39) which is formed in an upper portion of the piston (27) of the pump and whose bottom (40) communicates with the intake chamber (31) through a pressurizing bore (42) provided in said piston and has two openings comprising an injection opening (44) connected to the vaporization chamber (14) and a spray opening (45) connected to the spray (25), the two valves (59, 58) of the membrane (56) being located respectively adjacent the two said openings (45, 44) and their operation being subjected respectively to two manual control buttons, respectively a vaporization button (62) and a spray button (63), which project from an upper portion of the iron and of which the steam button (62) is connected to the valve (59) associated with the spray opening (45), whilst the spray button (63) is connected with the valve (58) associated with the injection opening (44), the membrane (56) passing from a rest position, defined when the pump (20) is primed, in which the two valves (58, 59) are closed and respectively obstruct the two openings (44, 45), to a working position, defined when one or the other of the two buttons (62, 63) is actuated, in which the valve (58; 59) associated with the actuated button (63; 62) is maintained closed by said button and obstructs the corresponding opening (45; 44), whilst the valve (58; 59) associated with the other button opens by deformation of the membrane (56) effected by the pressure of the pressurized water through the bore (42) of the piston and frees the corresponding opening (44; 45) through which passes the pressurized water.

2. Steam iron according to claim 1, wherein a body (21) of the pump (20) has a vertical axis of symmetry (XX') on which lies said bore (42) in the piston, and the two openings (44, 45) provided in the bottom (40) of the cap (39) are located symmetrically relatively to a vertical axis of symmetry (XX') of the body (21) of the pump.

3. Steam iron according to claim 1, wherein the membrane (56) has a substantially U-shaped straight section whose bottom (40) is flat and comprises the two valves (58, 59) and whose peripheral end edge (66) is maintained in bearing against an internal surface of the cap (39) by means of a member (68) forming a closure plug of the cap, said plug being traversed by said two buttons, respectively the steam button (62) and the spray button (63).

4. Steam iron according to claim 3, wherein the two buttons (62, 63) are push-buttons engages respectively in two bores (71, 72) in the closure plug (68), in line with the two valves (58, 59) of the membrane (56).

5. Steam iron according to claim 3, wherein the membrane (56) is of an elastomeric material and constitutes a sealing joint between the piston (27) and the closure plug (68).

6. Steam iron according to claim 2, wherein the two openings (44, 45) of the cap (39) open respectively into two transverse conduits (47, 48) forming an integral part of the piston (27) of the pump and connected respectively to the steam chamber (14) and to the spray (25) by a flexible tube (51; 53).

7. Steam iron according to claim 3, wherein the piston (27), the membrane (56) provided with the two valves (58, 59), the closure plug (68) and the two buttons (62, 63) constitute a unitary assembly.

8. Steam iron according to claim 1, which comprises moreover a non-return valve (75) interposed between the outlet of the pump (20), on the side of the injection orifice (44) provided in the bottom of the cap (39), and the inlet to the steam chamber (14).

* * * * *